US005237279A

United States Patent [19]

Shimasaki et al.

[11] Patent Number: 5,237,279

[45] Date of Patent: Aug. 17, 1993

[54] IGNITION AND FUEL SYSTEM MISFIRE-DETECTING SYSTEM FOR INTERNAL COMBUSTION ENGINES

[75] Inventors: Yuuichi Shimasaki; Masataka Chikamatsu; Takuji Ishioka; Shigetaka Kuroda; Hideaki Arai, all of Wako, Japan

[73] Assignee: Honda Giken Kogyo Kabushiki Kaisha, Tokyo, Japan

[21] Appl. No.: 846,635

[22] Filed: Mar. 5, 1992

[30] Foreign Application Priority Data

Mar. 7, 1991 [JP] Japan ..... 3-67935
Mar. 7, 1991 [JP] Japan ..... 3-67936

[51] Int. Cl.[5] ..... F02P 17/00; F02P 11/06

[52] U.S. Cl. ..... 324/391; 324/399; 123/479

[58] Field of Search ..... 324/388, 391, 392, 399; 361/253; 123/479, 480, 481

[56] References Cited

U.S. PATENT DOCUMENTS 3,942,102 3/1976 Kuhn et al. ..... 324/399
5,017,874 5/1991 DiNunzio et al. ..... 324/388

FOREIGN PATENT DOCUMENTS 51-22568 7/1976 Japan .

*Primary Examiner*—Walter E. Snow
*Attorney, Agent, or Firm*—Nikaido, Marmelstein, Murray & Oram

[57] ABSTRACT

A misfire-detecting system for an internal combustion engine detects a value of sparking voltage generated by the igniting device of the engine after generation of an ignition command signal, compares the value of the detected sparking voltage with a predetermined value, and determines whether or not a misfire has occurred in the engine, based upon the result of the comparison. The misfire-detecting system can discriminate between a misfire attributable to the fuel supply system of the engine and one attributable to the ignition system of the engine, from a detected peak value of the sparking voltage.

6 Claims, 8 Drawing Sheets

IGNITION AND FUEL SYSTEM MISFIRE-DETECTING SYSTEM FOR INTERNAL COMBUSTION ENGINES

BACKGROUND OF THE INVENTION 1. (Field of the Invention)

This invention relates to a misfire-detecting system for internal combustion engines, and more particularly to a misfire-detecting system which is capable of discriminating between a misfire attributable to the fuel supply system and one attributable to the ignition system.

2. (Prior Art)

In an internal combustion engine in general, high voltage (sparking voltage) generated by the ignition coil of the engine is sequentially distributed to the spark plugs of the cylinders of the engine via a distributor, to ignite a mixture supplied to the combustion chambers. If normal ignition does not take place at one or more of the spark plugs, i.e. a misfire occurs, it will result in various inconveniences such as degraded driveability and increased fuel consumption. Furthermore, it can also result in so-called after-burning of unburnt fuel gas in the exhaust system of the engine, causing an increase in the temperature of a catalyst of an exhaust gas-purifying device arranged in the exhaust system. Therefore, it is essential to prevent occurrence of a misfire. Misfires are largely classified into ones attributable to the fuel supply system and ones attributable to the ignition system. Misfires attributable to the fuel supply system are caused by the supply of a lean mixture or a rich mixture to the engine, while misfires attributable to the ignition system are caused by failure to spark (so-called misfiring), i.e. normal spark discharge does not take place at the spark plug, due to smoking or wetting of the spark plug with fuel, particularly adhesion of carbon in the fuel to the spark plug, which causes current leakage between the electrodes of the spark plug, or an abnormality in the ignition circuit.

A conventional misfire-detecting system is already known from Japanese Patent Publication (Kokoku) No. 51-22568, which utilizes the fact that the frequency of damping oscillation voltage generated in a primary circuit of an ignition device whenever the contacts of the distributor are opened is higher when a spark ignition occurs than when failure to spark occurs.

However, the conventional misfire-detecting system is only based upon the frequency of damping oscillation voltage generated in the ignition circuit, i.e. based upon whether or not a discharge occurs between the electrodes of the spark plug. Therefore, the conventional system is unable to discriminate whether a misfire detected is attributable to a cause in the fuel supply system such that although a discharge has actually occurred, the mixture is not fired due to its lean or rich state, or to a cause in the ignition system, thus failing to take a satisfactory and prompt fail-safe action.

SUMMARY OF THE INVENTION

It is, therefore, the object of the invention to provide a misfire-detecting system for internal combustion engines, which is capable of discriminating between a misfire attributable to the fuel supply system and one attributable to the ignition system.

To attain the above object, the present invention provides a misfire-detecting system for detecting a misfire occurring in an internal combustion engine having an ignition system including at least one spark plug, engine operating condition-detecting device for detecting values of operating parameters of the engine, signal-generating for determining ignition timing of the engine, based upon the detected values of the operating parameters of the engine and generating an ignition command signal indicative of the determined ignition timing, and igniting device responsive to the ignition command signal for generating sparking voltage for discharging the at least one spark plug.

The misfire-detecting system according to the invention is characterized by comprising:

voltage value-detecting device for detecting a value of the sparking voltage generated by the igniting device after generation of the ignition command signal; and misfire-determining device for comparing the value of the sparking voltage detected by the voltage value-detecting device with a predetermined value, and determining whether or not a misfire has occurred in the engine, based upon a result of the comparison.

Preferably, the voltage value-detecting device detects a peak value of the sparking voltage. The misfire-determining device determines that a misfire attributable to the fuel supply system has occurred, when the detected peak value exceeds the predetermined value; whereas it determines that a misfire attributable to the fuel supply system has occurred, when the detected peak value is below the predetermined value.

Further, the misfire-determining device determines that a misfire attributable to the ignition system has occurred, when the peak value of the sparking voltage detected within a predetermined time period elapsed from generation of the ignition command signal is below the predetermined value.

Preferably, the predetermined time period is set at a value at least equal to the maximum possible duration of a capacitive discharge state occurring immediately after generation of the ignition command signal.

Further preferably, the predetermined value is set in dependence on operating conditions of the engine.

The sparking voltage may be either primary voltage generated by the primary coil of the ignition coil, or second voltage generated by the secondary coil of the ignition coil.

The above and other objects, features, and advantage of the invention will become more apparent from the following detailed description taken in conjunction with the accompanying drawings.

DETAILED DESCRIPTION

The invention will now be described in detail with reference to the drawings showing an embodiment thereof.

Figure 1:
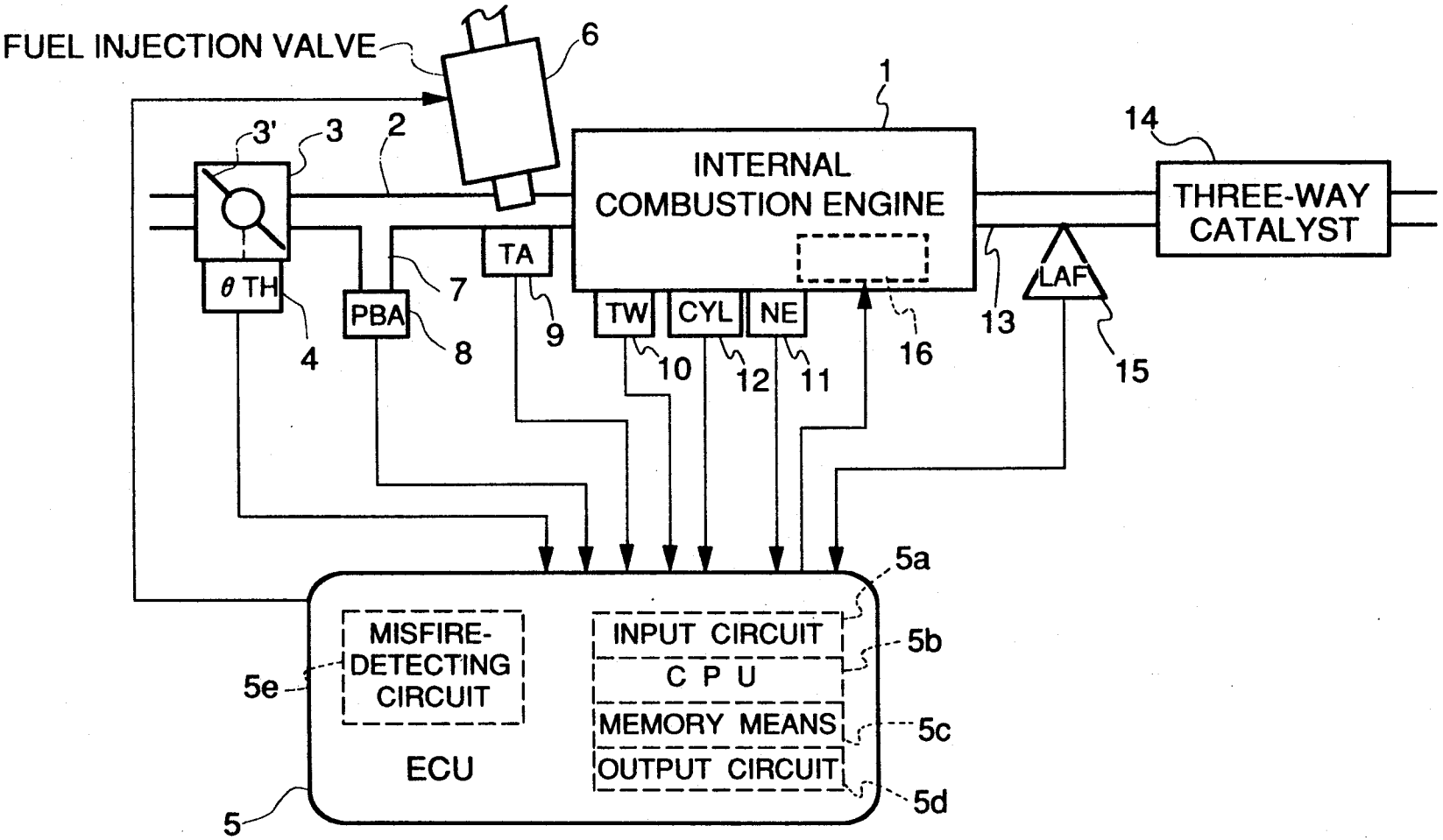
FIG. 1 is a block diagram showing the whole arrangement of an internal combustion engine incorporating a misfire-detecting system according to the invention.

Referring first to FIG. 1, there is shown the whole arrangement of an internal combustion engine incorporating a misfire-detecting system according to the invention. In an intake pipe 2 of an engine 1, there is arranged a throttle body 3 accommodating a throttle valve 3' therein. A throttle valve opening ($\theta$TH) sensor 4 is connected to the throttle valve 3' for generating an electric signal indicative of the sensed throttle valve opening and supplying the same to an electronic control unit (hereinafter referred to as "the ECU") 5.

Fuel injection valves 6 are each provided for each cylinder and arranged in the intake pipe at a location between the engine 1 and the throttle valve 3 and slightly upstream of an intake valve, not shown. The fuel injection valves 6 are connected to a fuel pump, not shown, and electrically connected to the ECU 5 to have their valve opening periods controlled by signals therefrom.

On the other hand, an intake pipe absolute pressure (PBA) sensor 8 is provided in communication with the interior of the intake pipe 2 via a conduit 7 at a location immediately downstream of the throttle valve 3' for supplying an electric signal indicative of the sensed absolute pressure to the ECU 5. An intake air temperature (TA) sensor 9 is inserted into the intake pipe 2 at a location downstream of the intake pipe absolute pressure sensor 8 for supplying an electric signal indicative of the sensed intake air temperature TA to the ECU 5.

An engine coolant temperature (TW) sensor 10, which may be formed of a thermistor or the like, is mounted in the cylinder block of the engine 1 for supplying an electric signal indicative of the sensed engine coolant temperature TW to the ECU 5. An engine rotational speed (NE) sensor 11 and a cylinder-discriminating (CYL) sensor 12 are arranged in facing relation to a camshaft or a crankshaft of the engine 1, neither of which is shown. The engine rotational speed sensor 11 generates a pulse as a TDC signal pulse at each of predetermined crank angles whenever the crankshaft rotates through 180 degrees, while the cylinder-discriminating sensor 12 generates a pulse at a predetermined crank angle of a particular cylinder of the engine, both of the pulses being supplied to the ECU 5.

A three-way catalyst 14 is arranged within an exhaust pipe 13 connected to the cylinder block of the engine 1 for purifying noxious components such as HC, CO and $NO_X$. An $O_2$ sensor 15 as an exhaust gas ingredient concentration sensor (referred to hereinafter as an "LAF sensor") is mounted in the exhaust pipe 13 at a location upstream of the three-way catalyst 14, for supplying an electric signal having a level approximately proportional to the oxygen concentration in the exhaust gases to the 1CU 5.

Further, an ignition device 16, which comprises an ignition coil, and spark plugs, hereinafter referred to, is provided in the engine 1 and controlled to effect spark ignition by an ignition command signal A from the ECU 5.

The ECU 5 comprises an input circuit 5*a* having the functions of shaping the waveforms of input signals from various sensors as mentioned above, shifting the voltage levels of sensor output signals to a predetermined level, converting analog signals from analog-output sensors to digital signals, and so forth, a central processing unit (hereinafter referred to as "the CPU") 5*b*, memory means 5*c* storing various operational programs which are executed by the CPU 5*b* and for storing results of calculations therefrom, etc., an output circuit 5*d* which outputs driving signals and the ignition command signal A to the fuel injection valves 6 and the ignition device 16, respectively, and a misfire-detecting circuit 5*e*, hereinafter described.

The CPU 5*b* operates in response to the abovementioned signals from the sensors to determine operating conditions in which the engine 1 is operating such as an air-fuel ratio feedback control region and open-loop control regions, and calculates, based upon the determined engine operating conditions, the valve opening period or fuel injection period $T_{OUT}$ over which the fuel injection valves 6 are to be opened in synchronism with inputting of TDC signal pulses to the ECU 5.

Further, the CPU 5*b* calculates the ignition timing TIG of the engine, based upon the determined engine operating condition.

The CPU 5*b* performs calculations as described hereinbefore, and supplies the fuel injection valves 6 and the ignition device 16, respectively, with driving signals and the ignition command signal A based on the calculation results through the output circuit 5*d*.

Figure 2:
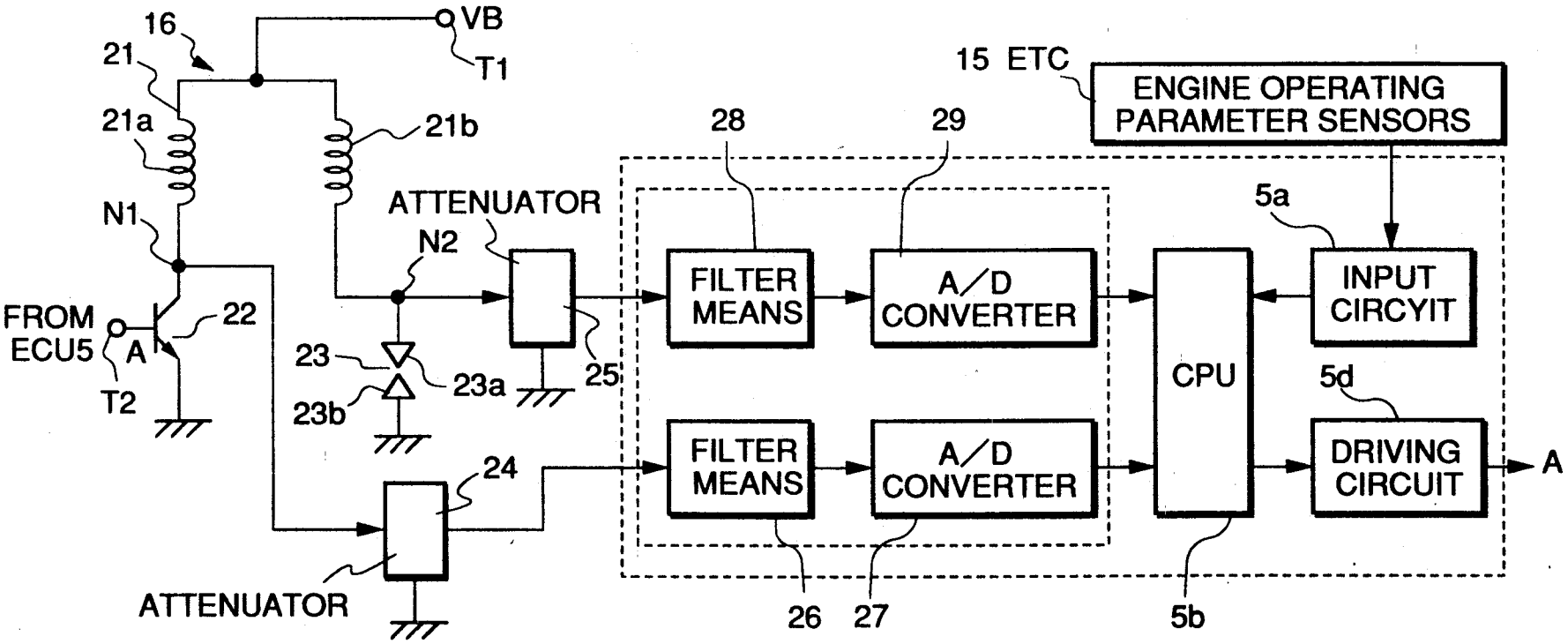
FIG. 2 is a block diagram showing a misfire-detecting system for an internal combustion engine according to an embodiment of the invention.

FIG. 2 shows the arrangement of the misfire-detecting system according to an embodiment of the invention. The misfire-detecting system according to this embodiment is adapted to detect whether or not a misfire has occurred and also whether the misfire is attributable to the fuel supply system or to the ignition system, from the magnitude of capacitive discharge voltage generated by discharging of the spark plug.

In FIG. 2, the ignition device 16 is constructed such that a feeding terminal T1, which is supplied with supply voltage VB, is connected to an ignition coil (igniting means) 21 comprised of a primary coil 21*a* and a secondary coil 21*b*. The primary and secondary coils 21*a*, 21*b* are connected with each other at one ends thereof. The other end of the primary coil 2 is connected to a collector of a transistor 22 by way of a node N1 at which sparking voltage (primary voltage) is generated. The transistor 22 has its base connected to an input terminal T2 which is supplied with the ignition command signal A and its emitter grounded. The other end of the secondary coil 21*b* is connected to a center electrode 23*a* of a spark plug 23 of each engine cylinder by way of a node N2 at which sparking voltage (secondary voltage) is generated. The spark plug 23 has its ground electrode 23*b* grounded. The node N1 is connected to an input of an attenuator (voltage value-detecting means) 24, while the node N2 is connected to an input of another attenuator (voltage value-detecting means) 25. The attenuators 24, 25 have their outputs connected to processing unit of the CPU 5*b* by way of filter means 26, 28 and A/D convertors 27, 29 of the ECU 5. The attenuators 24, 25 have attenuation factors of 1/1000 and 1/100, respectively, for example. The CPU 5*b* is connected to the base of the transistor 22 by way of the output circuit 5*d*, (driving circuit) which is supplied with the ignition command signal A, and also connected via the input circuit 5*a* to various engine operating parameter sensors (engine operating condition-detecting means) including the NE sensor 15 and the PBA sensor 8. The CPU 5*b* forms signal-generating means which determines the ignition timing based upon engine operating conditions and generates the ignition command signal A, and misfire-determining means which determines whether or not a misfire has occurred.

Figure 4:
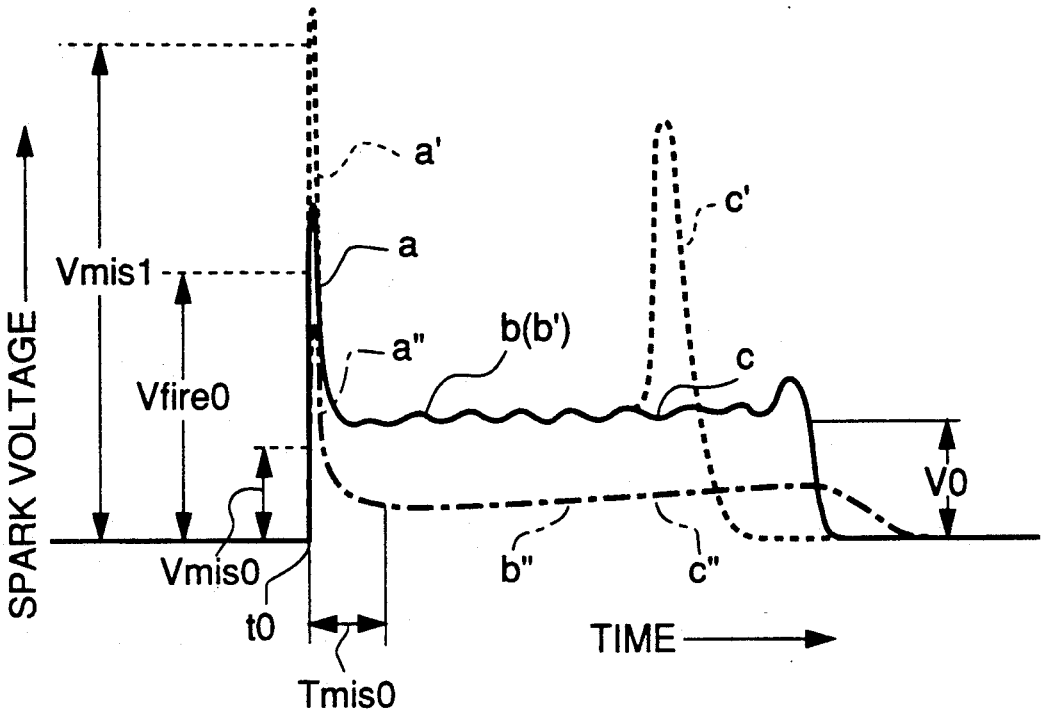
FIG. 4 is a timing chart showing changes in the primary voltage, useful in explaining misfires attributable to the fuel supply system.
Figure 6:
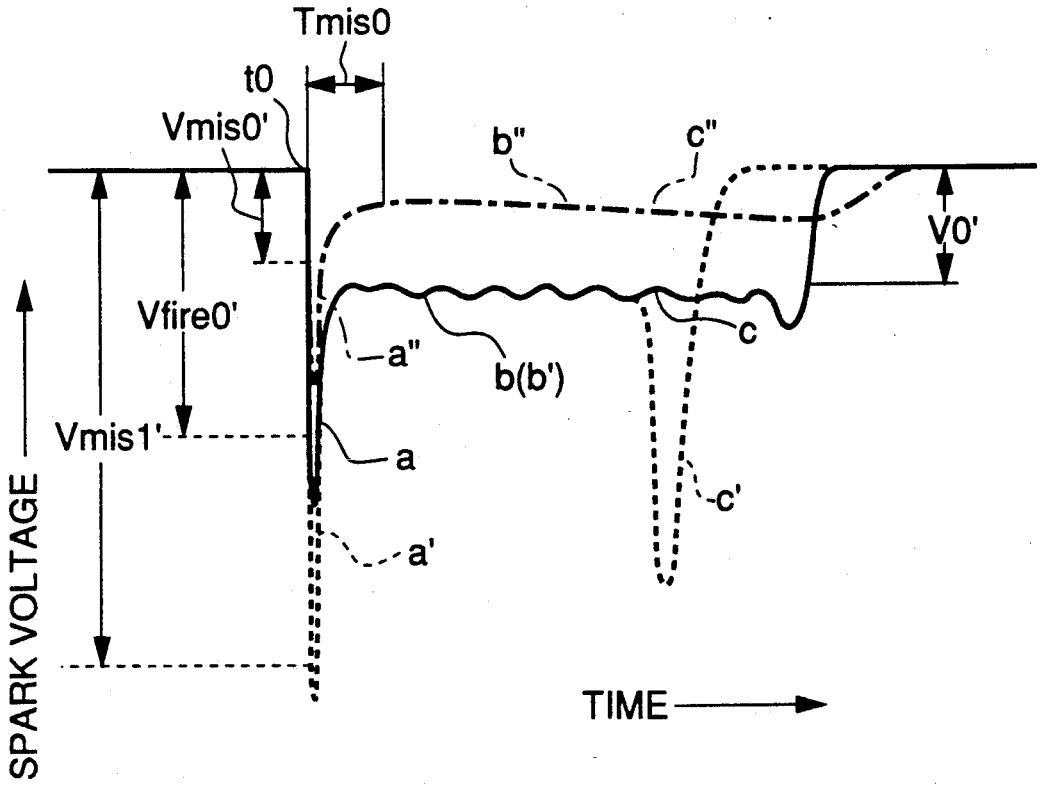
FIG. 6 is a timing chart showing changes in the secondary voltage, useful in explaining misfires attributable to the fuel supply system.

FIGS. 4 and 6 are timing charts showing, respectively, sparking voltage (primary voltage) generated by the primary coil 21*a* of the ignition coil 21, and sparking voltage (secondary voltage) generated by the secondary coil 21*b*, the voltages being generated in response to the ignition command signal A.

These figures are useful in explaining misfires attributable to the fuel supply system. In each of FIGS. 4 and 6, the solid lines indicate a sparking voltage obtained when the mixture is normally fired, and the broken lines and the chain lines indicate sparking voltages obtained when misfires occur due to a lean mixture and a rich mixture, respectively.

Sparking voltage characteristics obtainable in the above respective cases will now be explained with reference to FIG. 4.

First, a sparking voltage characteristic obtainable in the case of normal firing will be explained, which is indicated by the solid lines. Suppose that immediately after a time point t0 the ignition command signal A is generated. Then, sparking voltage rises to such a level as to cause dielectric breakdown of the mixture between the electrodes of the spark plug (curve a). For example, as shown in FIG. 4, when the sparking voltage has exceeded a reference voltage value Vfire0 for determination of a normal firing, i.e. $V > Vfire0$, dielectric breakdown of the mixture occurs, and then the discharge state shifts from a capacitive discharge state before the dielectric breakdown to an inductive discharge state where the sparking voltage assumes almost a constant value (curve b). The inductive discharge voltage rises with an increase in the pressure within the engine cylinder caused by the compression stroke of the piston executed after the time point t0, since a higher voltage is required for inductive discharge to occur as the cylinder pressure increases. At the final state of the inductive discharge, the voltage between the electrodes of the spark plug lowers below a value required for the inductive discharge to continue, due to decreased inductive energy of the ignition coil so that the inductive discharge ceases and again capacitive discharge occurs. In this capacitive discharge state, the voltage between the spark plug electrodes again rises, i.e. in the direction of causing dielectric breakdown of the mixture. However, since the ignition coil 21 then has a small amount of residual energy, the amount of rise of the voltage is small (curve c).

Next, reference is made to a sparking voltage characteristic indicated by the broken lines, which is obtained when a misfire occurs, which is caused by the supply of a lean mixture to the engine or cutting-off of the fuel supply to the engine due to failure of the fuel supply system, etc. Immediately after the time point t0 of generation of the ignition command signal A, the sparking voltage rises above a level causing dielectric breakdown of the mixture. In this case, the ratio of air in the mixture is greater than when the mixture has an air-fuel ratio close to a stoichimetric ratio, and accordingly the dielectric strength of the mixture is high. Consequently, the dielectric breakdown voltage becomes higher than that obtained in the case of normal firing of the mixture (curve a'), as shown in FIG. 4.

Thus, the sparking voltage V exceeds a reference voltage value Vmis1 for determining a misfire attributable to the fuel supply system ($V > Vmis1$). Thereafter, the discharge state shifts to an inductive discharge state, as in the case of normal firing (curve b'). Also, electrical the resistance of the discharging gap of the plug at the discharge of the ignition coil is greater in the case of supply of a lean mixture, etc. than that in the case of normal firing so that the inductive discharge voltage rises to a higher level than at normal firing, resulting in an earlier shifting from the inductive discharge state to a capacitive discharge state. The capacitive discharge voltage upon the transition from the inductive discharge state to the capacitive discharge state is by far higher than that at normal firing (curve c'), because the voltage of dielectric breakdown of the mixture is higher than that at normal firing, and also because the ignition coil still has a considerable amount of residual energy due to the earlier termination of the inductive discharge (i.e. the discharge duration is shorter).

Next, reference is made to a sparking voltage characteristic indicated by the chain lines, which can be obtained when a misfire occurs due to the supply of a rich mixture or an overrich mixture to the engine. Although immediately after the time point t0 the sparking voltage V rises to a level causing dielectric breakdown of the mixture, the dielectric breakdown voltage in this case is lower than in the case of normal firing (curve a''), because the ratio of air in the mixture is smaller than that at normal firing and hence the dielectric strength of the mixture is smaller. That is, $Vfire0 > V > Vmis0$ holds, as shown in FIG. 4, where Vmis0 represents a reference voltage value for determining a misfire attributable to the ignition system. After that, the discharge state shifts to an inductive discharge state, similarly to the case of normal firing. Since the resistance at the inductive discharge is smaller than that in the case of normal firing, the inductive discharge voltage is lower so that shifting to a capacitive discharge state takes place at a later time than in the case of normal firing (curve b''). Further, since the dielectric breakdown voltage of the mixture is lower than in the case of normal firing, and consequently the inductive discharge continues for a longer time period (i.e. the discharge duration is longer), the capacitive discharge voltage generated upon the transition from the inductive discharge state to the capacitive discharge state is lower than in the case of normal firing, due to the smaller amount of residual energy of the ignition coil (curve c'').

As shown in FIGS. 4 and 6, the sparking voltage (secondary voltage) generated by the secondary coil 21*b* of the ignition coil 21 presents almost identical characteristics with those described above with respect to the sparking voltage (primary voltage) generated by the primary coil 21*a* of the ignition coil 21. Therefore, description of the secondary voltage characteristics is omitted.

Figure 3:
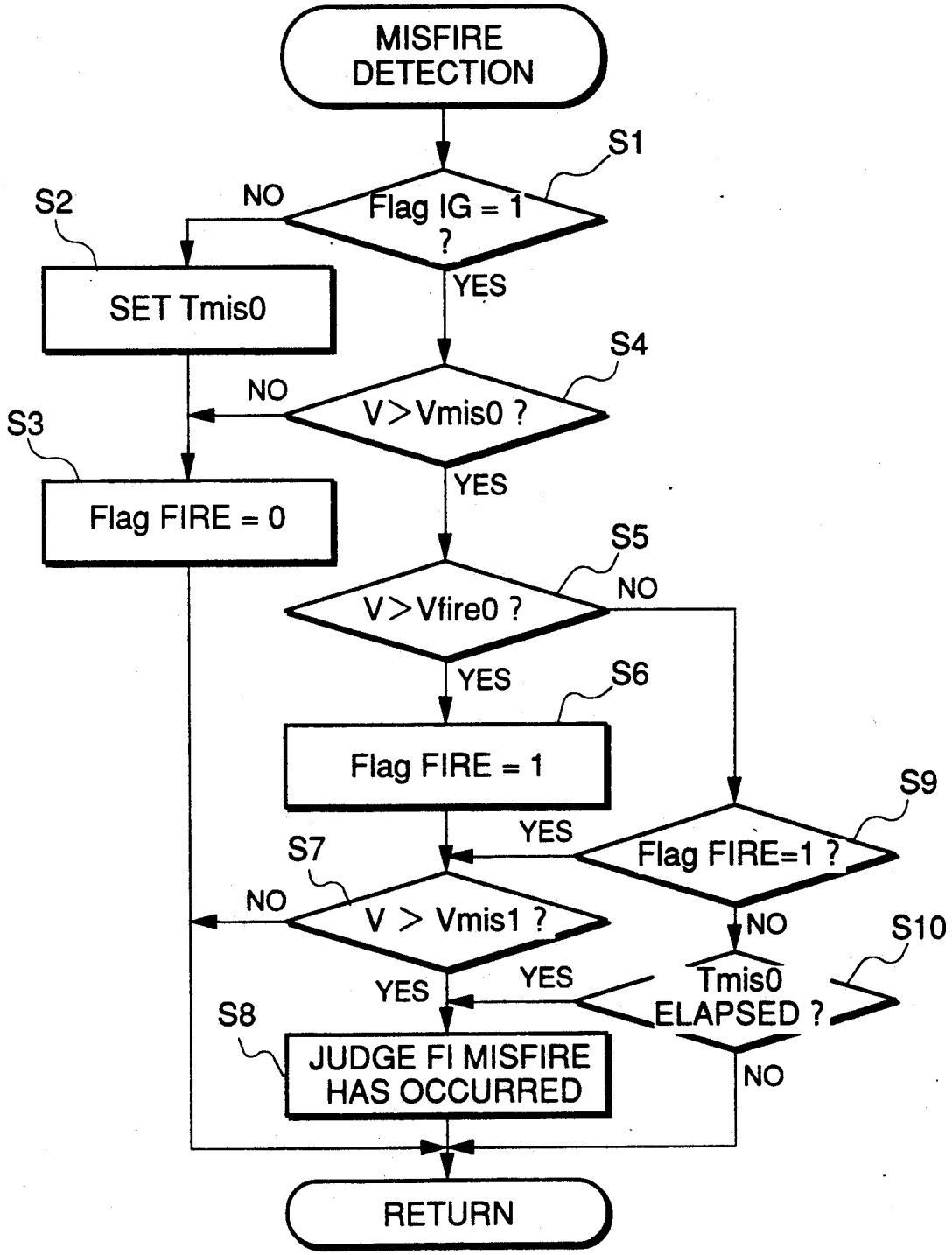
FIG. 3 is a flowchart showing a program for detecting a misfire attributable to the fuel supply system, based upon the primary voltage (sparking voltage) of an ignition coil in FIG. 1.

Next, the operation of the misfire-detecting circuit of FIG. 2 based upon the primary voltage of the ignition coil 21 will be explained with reference to FIGS. 3 and 4. FIG. 3 shows a program for detecting a misfire attributable to the fuel supply system by means of the FIG. 2 circuit. This program is executed at predetermined fixed time intervals.

First, it is determined at a step S1 whether or not a flag IG, which is indicative of whether or not the ignition command signal A has been generated, has been set to a value of 1. The flag IG indicates, when set to 1, that the signal A has been generated. The flag IG is thus set to 1 upon generation of the signal A and then again reset to 0 upon the lapse of a predetermined time period thereafter. When the ignition command signal A has not been generated, the answer to the question of the step S1 is negative (No), and then the program proceeds to steps S2 and S3, where a timer within the ECU5 is set to a predetermined time period Tmis0 and started, and a flag FIRE is set to 0, followed by terminating the program. The predetermined time period Tmis0 is set at a time period equal to or longer than the maximum possible duration of the capacitive discharge occurring immediately after the generation of the ignition command signal A, and is read from a map or a table in accordance with operating conditions (operating parameter values) of the engine 1. Setting and resetting of the flag IG is effected by a routine other than the FIG. 3 routine, e.g. an ignition timing-calculating routine.

When the ignition command signal A has been generated and hence the flag IG has been set to 1, the program proceeds from the step S1 to a step S4 to determine whether or not the sparking voltage V has exceeded the reference voltage value Vmis0 for determining a misfire attributable to the ignition system (see FIG. 4). The reference voltage value Vmis0 is read from a map or a table in accordance with engine operating conditions, e.g. engine rotational speed, engine load, battery voltage, and engine temperature. The value Vmis0 is set to a value equal to or lower than inductive discharge voltage VO generated in the case of normal firing (FIG. 4). The reference voltage values Vfire0, Vmis1, referred to hereinafter, are also read from maps or tables in accordance with engine operating conditions. When $V \leqq Vmis0$ holds at the step S4, the program proceeds to the step S3 where the flag FIRE is reset to 0, followed by terminating the program. If $V > Vmis0$ holds at the step S4, the program proceeds to a step S5 where it is determined whether or not the sparking voltage V has exceeded the reference voltage value Vfire0 for determining normal firing (second predetermined value) (FIG. 4). If $V > Vfire0$ holds, it is determined that normal firing has occurred, and then the program proceeds to a step S6 to set the flag FIRE to 1. Then, it is determined at a step S7 whether or not the sparking voltage V has exceeded the reference value Vmis1 for determining a misfire attributable to the fuel supply system (first predetermined value) (FIG. 4). If $V > Vmis1$ holds, it is determined at a step S8 that a misfire attributable to the fuel supply system (hereinafter called "FI misfire") has occurred due to the supply of a lean mixture or cutting-off of the fuel supply. If $V \leqq Vmis1$ holds, it is determined that no FI misfire has occurred, and then the program is terminated.

If $V \leqq Vfire0$ holds at the step S5, the program proceeds to a step S9 to determine whether or not the flag FIRE has been set to 1, i.e. whether or not $V > Vfire0$ has held at least one time after generation of the ignition command signal A. If the flag FIRE is equal to 1, it means that $V > Vfire0$ has been satisfied at least one time between the time of generation of the ignition command signal A and the present time. Then, the determination as to $V > Vmis1$ is executed at the step S7, followed by terminating the program, since if $V \leqq Vfire0$ holds, $V < Vmis1$ should hold. If the flag FIRE has not been set to 1 at the step S9, i.e. if $V > Vfire0$ has never held until the present time, in other words, the sparking voltage has never risen above the reference voltage value Vfire0 until the present time, the program proceeds to a step S10 to determine whether or not the predetermined time period Tmis0 has elapsed from the time of generation of the ignition command signal A. If the predetermined time period Tmis0 has elapsed, it is determined that the capacitive discharge state occurring immediately after the generation of the ignition command signal A has terminated (FIG. 4). Then, it is finally determined that an FI misfire has occurred due to the supply of a rich mixture or an overrich mixture. If the predetermined time period Tmis0 has not yet elapsed, the final judgement as to the occurrence of an FI misfire is suspended until the next execution of the present program.

Figure 5:
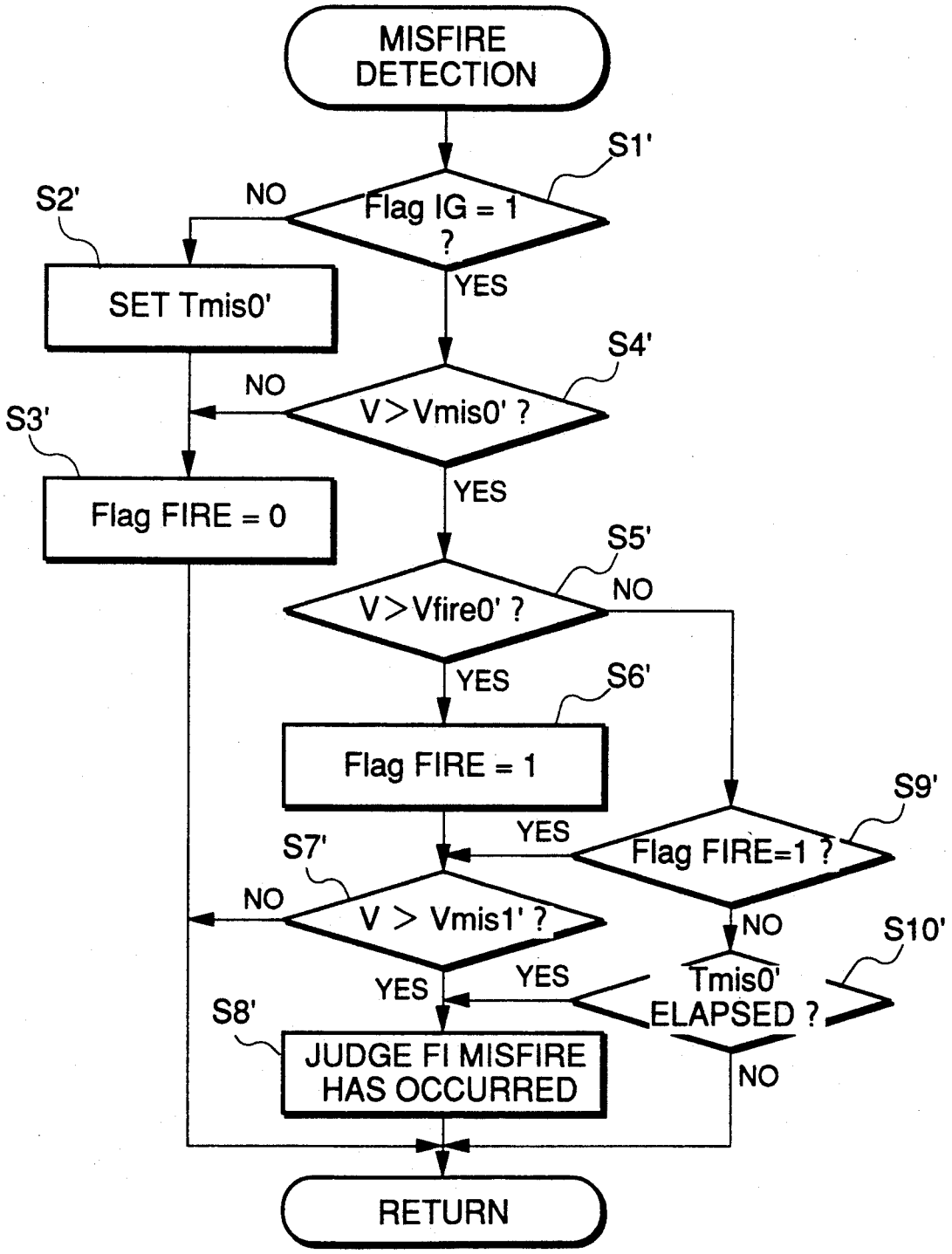
FIG. 5 is a flowchart showing a program for detecting a misfire attributable to the fuel supply system, based upon the secondary voltage (sparking voltage) of ignition coil.

Next, reference is made to FIGS. 5 and 6 showing a manner of detecting an FI misfire, based upon the secondary voltage of the ignition coil, by means of the present misfire-detecting system. In FIGS. 5 and 6, a predetermined time period Tmis0', and reference voltage values Vmis0', Vfire0', Vmis1', and V0' correspond, respectively, to Tmis0, and Vmis0, Vfire0, Vmis1, and VO in FIGS. 3 and 4. The operation shown in FIG. 5 is the same with the operation shown in FIG. 3 described above, and therefore description thereof is omitted. The values Tmis0 and Tmis0' may be either equal to each other or different from each other. The reference voltage values Vmis0, Vfire0, and Vmis1 are usually set to respective smaller values than Vmis0', Vfire0', and Vmis1'.

It will be understood from the above given description that actually the programs of FIGS. 3 and 5 determine whether a peak value VP of the sparking voltage V satisfies the relationship of $Vfire0 < VP < Vmis1$ or $Vfire0' < VP < Vmis1'$ (FIG. 4 and 6), and determine that normal firing has occurred if the above relationship is satisfied, and an FI misfire has occurred if the relationship is not satisfied.

In the above described manner, according to the invention, the occurrence of an FI misfire can be accurately determined, thereby making it possible to determine the faulty place at an early time and take an appropriate fail-safe action.

Next, a manner of detecting a misfire attributable to the ignition system according to the invention will now be described with reference to FIGS. 7–10. In FIGS. 7–10, values corresponding to those in FIGS. 3–6 are designated by identical symbols.

Figure 8:
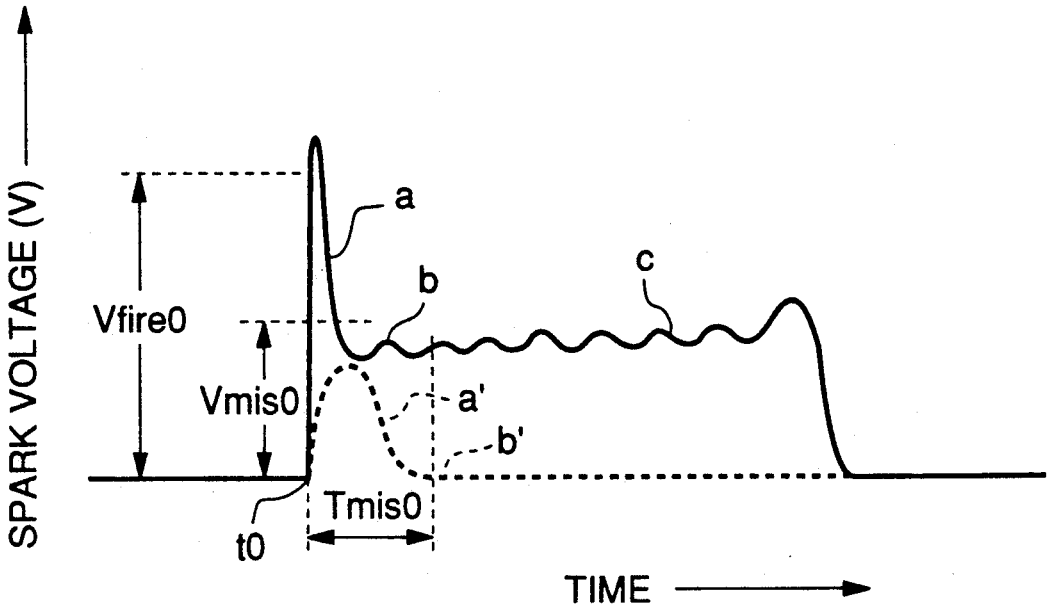
FIG. 8 is a timing chart showing a change in the primary voltage, useful in explaining a misfire attributable to the ignition system.
Figure 10:
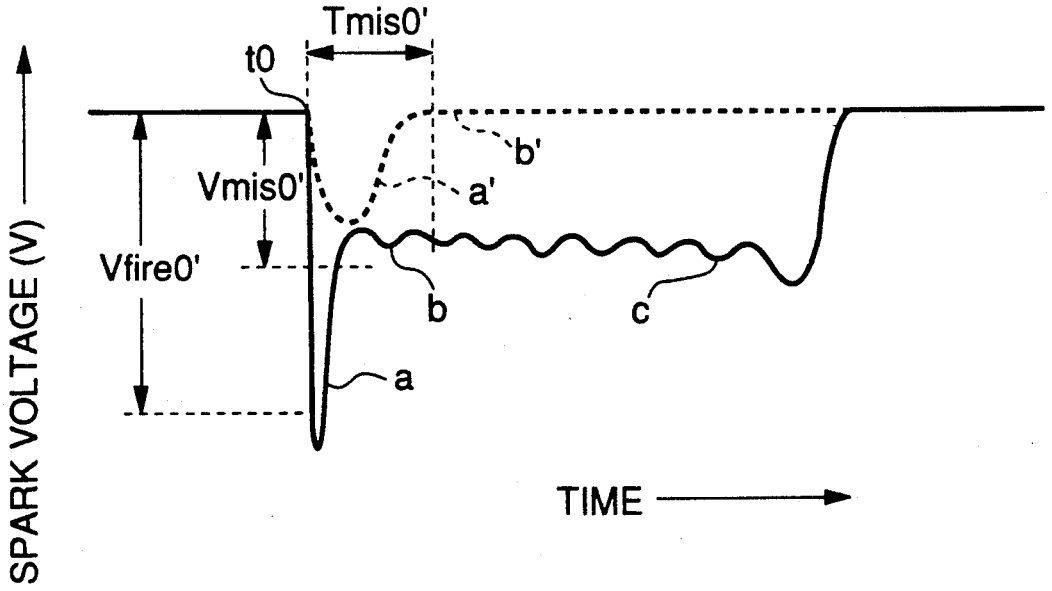
FIG. 10 is a timing chart showing a change in the secondary voltage, useful in explaining a misfire attributable to the ignition system.
Figure 9:
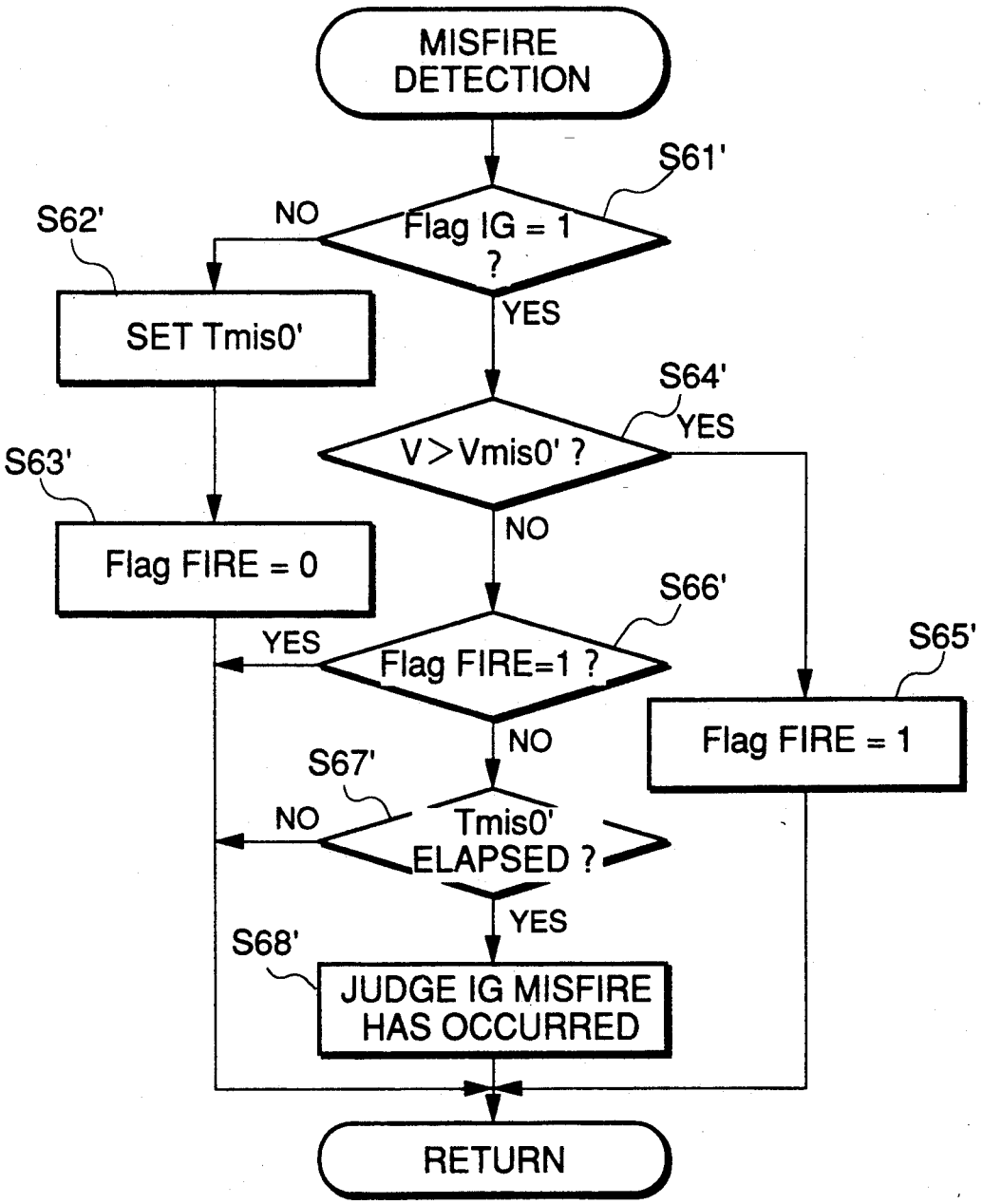
FIG. 9 is a flowchart showing a program for detecting a misfire attributable to the ignition system.

FIGS. 8–10 are timing charts similar, respectively, to FIGS. 4 and 6, which are useful in explaining a misfire attributable to the ignition system. In FIGS. 8 and 10, the solid lines indicate sparking voltage obtained when the mixture is normally fired, and the broken lines sparking voltage obtained when a misfire attributable to the ignition system (hereinafter called "IG misfire") has occurred.

A sparking voltage characteristic obtained at normal firing is indicated by the solid line curves a, b and c, as previously explained with reference to FIG. 4.

Next, a sparking voltage characteristic (indicated by the broken lines) will be explained, which is obtained when there occurs smoking of the spark plug with fuel or the like to cause substantial conduction between the electrodes of the spark plug. This substantially conductive state is equivalent to a state in which the electrodes of the spark plug are electrically connected with each other via a low resistance. As a result, energy stored in the ignition coil is released in a moment into a large current. Consequently, the sparking voltage V does not rise to a level as high as the reference voltage value Vmis0 for determining an IG misfire (curve a'), followed by declining to zero volt (curve b'). The broken line sparking voltage characteristic can be assumed even in the case of failure of the ignition circuit, in which case it is also correctly determined that an IG misfire has occurred.

Secondary voltage characteristics shown in FIG. 10 are similar to the primary voltage characteristics shown in FIG. 8, description of which is, therefore, omitted.

Figure 7:
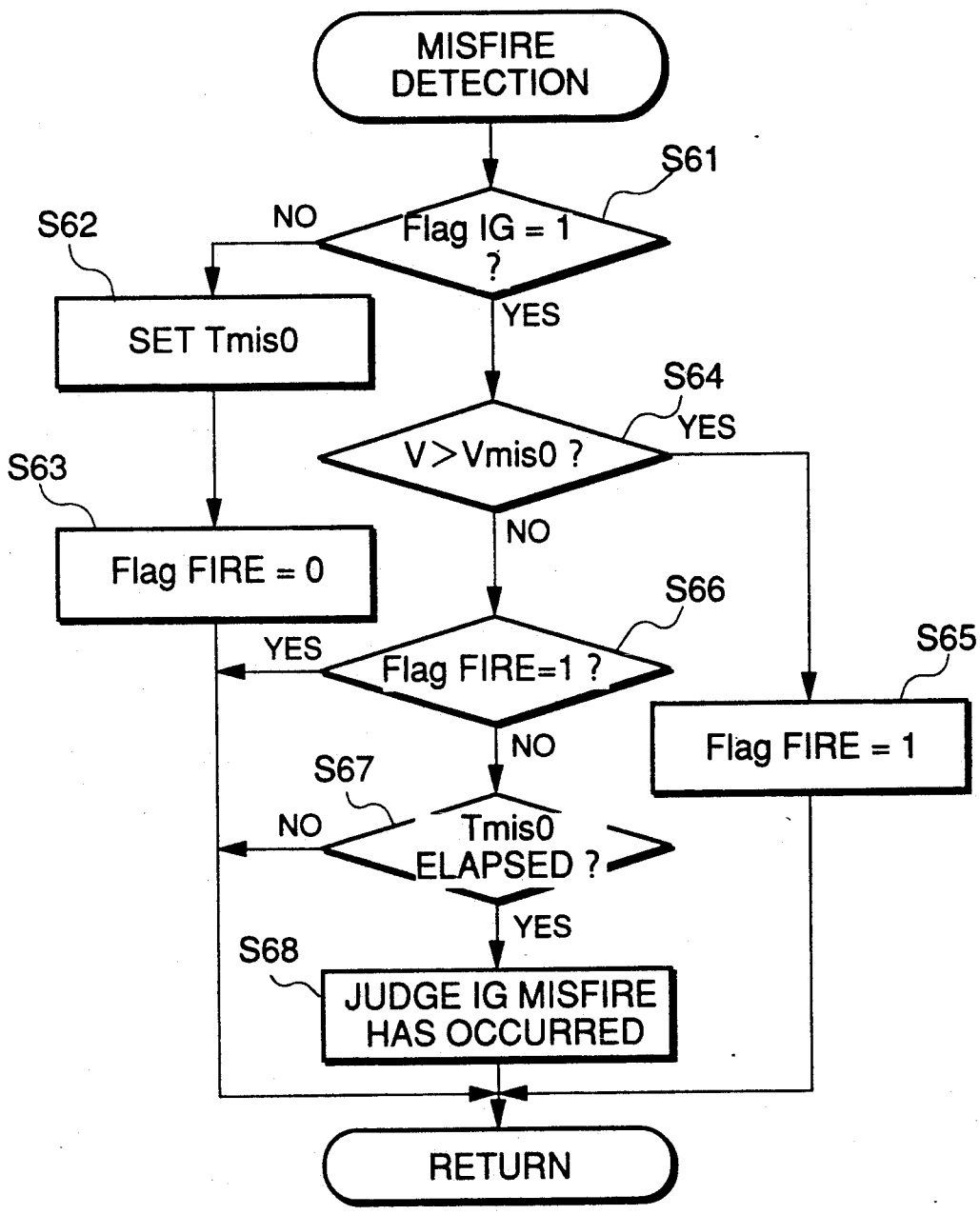
FIG. 7 is a flowchart showing a program for detecting a misfire attributable to the ignition system, based upon the primary voltage.

Next, a manner of detecting an IG misfire attributable to the ignition system, based upon the primary voltage of the ignition coil, will now be explained with reference to FIGS. 7 and 8. The program of FIG. 7 is executed at predetermined fixed time intervals.

First, it is determined at a step S61 whether or not the flag IG, which is indicative of whether or not the ignition command signal A has been generated, has been set to 1. When the ignition command signal A has not been generated, the answer to the question of the step S1 is negative (No), and then the program proceeds to steps S62 and S63, where the timer within the ECU5 is set to the predetermined time period Tmis0 and started, and the flag FIRE is set to 0, followed by terminating the program. As mentioned before, the predetermined time period Tmis0 is set at a time period equal to or longer than the maximum possible duration of the capacitive discharge occurring immediately after generation of the ignition command signal A, and is read from a map or a table in accordance with operating conditions (operating parameter values) of the engine 1.

When the ignition command signal A has been generated and hence the flag IG has been set to 1, the program proceeds from the step S61 to a step S64 to determine whether or not the sparking voltage V has exceeded the reference voltage value Vmis0 for determining a misfire (see FIG. 8). As mentioned before, the reference voltage value Vmis0 is read from a map or a table in accordance with engine operating conditions, e.g. engine rotational speed, engine load, battery voltage, and engine temperature. If $V > Vmis0$ holds at the step S64, the program proceeds to a step S65 where the flag FIRE is set to 1, followed by terminating the program. When $V \leqq Vmis0$ holds at the step S64, the program proceeds to a step S66 where it is determined whether or not the flag FIRE has been set to 1, i.e. whether or not $V > Vmis0$ has held at least one time after the generation of the ignition command signal A.

If the sparking voltage V has exceeded the reference value Vmis0 at least one time, it is determined that no IG misfire has occurred, followed by terminating the program. If it is determined at the step S66 that the flag FIRE has not been set to 1, it is determined at a step S67 whether or not the timer has counted up the predetermined time period Tmis0. If the predetermined time period Tmis0 has elapsed, it is finally determined at a step S68 that an IG misfire has occurred; whereas if the predetermined time period Tmis0 has elapsed, the determination as to the occurrence of an IG misfire is suspended, since there is a possibility that $V > Vmis0$ can be satisfied afterward.

Next, reference is made to FIGS. 9 and 10 showing a manner of detecting an IG misfire, based upon the secondary voltage of the ignition coil by means of the misfire-detecting circuit. In FIGS. 9 and 10, a predetermined time period Tmis0', and reference voltage values Vmis0', and Vfire0' correspond, respectively, to Tmis0, Vmis0, and Vfire0 in FIGS. 7 and 8. The operation shown in FIG. 9 is the same with the operation shown in FIG. 7 described above, and therefore description thereof is omitted. Further, the values Tmis0 and Tmis0' may be either equal to each other or different from each other. The reference voltage value Vmis0, is usually set to a smaller value than Vmis0'.

It will be understood from the above given description that like the programs of FIGS. 3 and 5 described before, actually the programs of FIGS. 7 and 9 determine whether a peak value VP of the sparking voltage V satisfies the relationship of $VP > Vmis0$ or $VP > Vmis0'$ (FIGS. 8 and 10), and determine that normal firing has occurred if the above relationship is satisfied as indicated by the solid lines in FIGS. 8 and 10, and an IG misfire has occurred if the relationship is not satisfied, i.e. $VP \leqq Vmis0$ or $VP \leqq Vmis0'$, as indicated by the broken lines.

In the above described manner, according to the invention, the occurrence of an IG misfire can also be accurately determined, thereby making it possible to determine the faulty place at an early time and take an appropriate fail-safe action.

What is claimed is:

1. A misfire-detecting system for detecting a misfire occurring in an internal combustion engine having an ignition system including at least one spark plug and having a fuel supply system for supplying a mixture to said engine, engine operating condition-detecting means for detecting values of operating parameters of said engine, signal-generating means for determining ignition timing of said engine, based upon the detected values of said operating parameters of said engine and generating an ignition command signal indicative of the determined ignition timing, and igniting means responsive to said ignition command signal for generating sparking voltage for discharging said at least one spark plug, said misfire detecting system comprising:

voltage value-detecting means for detecting a peak value of said sparking voltage generated by said ignition means after generation of said ignition command signal; and misfire-determining means for comparing the value of said sparking voltage detected by said voltage value-detecting means with first and second predetermined values, and for determining whether or not a misfire has occurred in said engine, based upon a result of said comparison, and misfire-determining means determining that: a misfire has occurred due to supply of a lean mixture from said fuel supply system to said engine or cutting-off of supply of fuel from said fuel supply system to said engine, when the detected peak value exceeds said first predetermined value; and a misfire has occurred due to supply of a rich mixture or an overrich mixture from said fuel supply system to said engine, when the detected peak value is below said second predetermined value lower than said first predetermined value.

2. A misfire-detecting system for detecting a misfire occurring in an internal combustion engine having an ignition system including at least one spark plug and having a fuel supply system for supplying a mixture to said engine, engine operating condition-detecting means for detecting values of operating parameters of said engine, signal-generating means for determining ignition timing of said engine, based upon the detected values of said operating parameters of said engine and generating an ignition command signal indicative of the determined ignition timing, and igniting means responsive to said ignition command signal for generating sparking voltage for discharging said at lease one spark plug, said misfire detecting system comprising:

voltage value-detecting means for detecting a peak value of said sparking voltage generated by said igniting means after generation of said ignition command signal; and misfire-determining means for comprising the value of said sparking voltage detected by said voltage value-detecting means with first, second and third predetermined values, and for determining whether or not a misfire has occurred in said engine, based upon a result of said comparison, said misfire-determining means determining that: a misfire has occurred due to supply of a lean mixture from said fuel supply system to said engine or cutting-off of supply of fuel from said fuel supply system to said engine, when the detected peak value exceeds said first predetermined value; a misfire has occurred due to supply of a rich mixture or an overrich mixture from said fuel supply system to said engine, when the detected peak value is below said second predetermined value: and a misfire attributable to said ignition system has occurred, when said peak value of said sparking voltage detected within a predetermined time period elapsed from generation of said ignition command signal is below said third predetermined value lower than said second predetermined value.

3. A misfire-detecting system as claimed in claim 2, wherein said predetermined time period is set at a value at least equal to a maximum possible duration of a capacitive discharge state occurring immediately after generation of said ignition command signal.

4. A misfire-detecting system as claimed in claim 1, wherein said first predetermined value is set in dependence on operating conditions of said engine.

5. A misfire-detecting system as claimed in any of claims 1 or 2, wherein said igniting means comprises a primary coil and a secondary coil, said sparking voltage being primary voltage generated by said primary coil.

6. A misfire-detecting system as claimed in any of claims 1 or 2, wherein said igniting means comprises a primary coil and a secondary coil, said sparking voltage being secondary voltage generated by said secondary coil.

* * * * *